United States Patent [19]

Schukei et al.

[11] 4,407,236

[45] Oct. 4, 1983

[54] SLUDGE LANCE FOR NUCLEAR STEAM GENERATOR

[75] Inventors: Glen E. Schukei, South Windsor; Frank J. Formanek, West Suffield, both of Conn.

[73] Assignee: Combustion Engineering, Inc., Windsor, Conn.

[21] Appl. No.: 303,698

[22] Filed: Sep. 21, 1981

[51] Int. Cl.[3] ..... F22B 37/52

[52] U.S. Cl. ..... 122/390; 15/316 R; 165/95; 122/382

[58] Field of Search ..... 122/390, 391, 392, 396, 122/382; 165/95; 15/318, 316 R

[56] References Cited

U.S. PATENT DOCUMENTS 2,112,896 4/1938 Husband ..... 122/390 X
3,344,459 10/1967 Jankowski ..... 122/392 X
4,276,856 7/1981 Dent et al. ..... 122/382
4,351,277 9/1982 Ryan ..... 122/390

*Primary Examiner*—Edward G. Favors
*Attorney, Agent, or Firm*—Arthur L. Wade

[57] ABSTRACT

A long, thin strip of spring steel functions as the support base for one or more capillary tubes. The strip and its attached capillary tubes are thrust through a handhole in the side of a vessel containing a tube bundle and diverted by a guide into predetermined open lanes formed by the tubes of the bundle. The forward ends of the capillary tubes are directed downward for the jetting of fluid under high pressure into a body of sludge collected between the tubes and on the upper side of the tubes and their tube sheet. The source of the fluid is connected to the rear ends of the capillary tubes as the supply of fluid under high pressure.

8 Claims, 4 Drawing Figures

SLUDGE LANCE FOR NUCLEAR STEAM GENERATOR

TECHNICAL FIELD

The present invention relates to structures providing jet streams for the removal of sludge deposits from the tube sheets of steam generators. More particularly, the invention relates to a lance by which jetted fluid can be directed down lanes of the tubes of a steam generator to inject the fluid into a body of sludge which has collected above the tube sheet and about its tubes.

BACKGROUND ART

A typical nuclear steam generator comprises a vertically oriented shell, a plurality of U-shaped tubes disposed in the shell so as to form a tube bundle, a tube sheet for supporting the tubes at the ends opposite their U-like curvature, a dividing plate which is arranged with the tube sheet to form a primary fluid inlet header at one end of the tube bundle and a primary fluid outlet header at the other end of the tube bundle, a primary fluid inlet nozzle in fluid communication with the primary fluid inlet header and a primary fluid outlet nozzle in fluid communication with the primary fluid outlet header. The steam generator also comprises a wrapper sheet disposed between the tube bundle and the shell to form an annular chamber with the internal shell, and a feedwater ring disposed above the U-line curvature end of the tube bundle. The primary fluid having been heated by circulation through the reactor core enters the steam generator through the primary fluid inlet nozzle. From the primary fluid inlet nozzle, the primary fluid flows through the primary fluid inlet header, through the tubes of the bundle, out the primary fluid outlet header, through the primary fluid outlet nozzle to the remainder of the reactor coolant system. At the same time, feedwater is introduced to the steam generator through the feedwater ring. The feedwater is conducted down the annular chamber adjacent the shell until the tube sheet near the bottom of the annular chamber causes the feedwater to reverse direction passing in heat transfer relationship with the outside of the U-shaped tubes of the bundle and up through the inside of the wrapper. While the feedwater is circulating in heat transfer relationship with the tubes of the bundle, heat is transferred from the primary fluid in the tubes to the feedwater over the outside of the tubes, causing some predetermined portion of the feedwater to be converted to steam. The steam then rises and is circulated through typical electrical generating equipment producing electricity in a manner well-known in the art.

Since the primary fluid contains radioactive particles and is isolated from the feedwater only by the walls of the U-shaped tubes which may be constructed from Inconel, the U-tube walls form part of the primary boundary for isolating these radioactive particles. It is, therefore, important that the U-tubes be maintained defect-free so that no breaks will occur in the U-tubes. However, experience has shown that under certain conditions the U-tubes may develop leaks therein which allow radioactive particles to contaminate the feedwater, a highly undesirable result.

There is now thought to be at least two causes of tube leaks in steam generators. One cause of these leaks is considered to be related to the chemical environment of the feedwater side of the tubes. Analysis of tube samples taken from operating steam generators which have experienced leaks has shown that the leaks were caused by cracks in the tubes resulting from intergranular corrosion. High caustic levels found in the vicinity of the cracks in the tube specimens taken from operating steam generators, and the similarity of these cracks to failures produced by caustic under controlled laboratory conditions have identified high caustic levels as a cause of the intergranular corrosion and thus the cause of the tube cracking.

Another cause of tube leaks is inferred to be from tube thinning. Eddy current tests of the tubes have indicated that the thinning occurs on the tubes near the tube sheet at levels corresponding to the levels of sludge that has accumulated on the tube sheet. The sludge is mainly iron oxides and copper compounds along with traces of other metals that have settled out of the feedwater onto the tube sheet. The level of sludge accumulation may be inferred by eddy current testing with a low frequency signal that is sensitive to the magnetite in the sludge. The correlation between sludge levels and tube wall thinning locations strongly implies that the sludge deposits provide a site for concentration of the phosphate solution or other corrosive agents at the tube wall that result in tube thinning.

One known method for removal of this sludge is referred to as sludge lancing. Sludge lancing consists of using high pressure water to break up and slurry the sludge in conjunction with suction and filtration equipment that removes the water-sludge mixture for disposal or recirculation. An excellent discussion of the background of this system is disclosed in U.S. Pat. No. 4,079,701, Robert A. Hickman, et al., issued Mar. 21, 1978. All of the problems of this system center around the removal of sludge by the mechanical arrangement of lance manipulation to drive the sludge into a suction header.

The present problem is generated by small dimensions of the tube lanes in the tube bundles of steam generators requiring sludge removal. It is only marginally practical to direct a jet down a tube lane of 0.4" width and 4 foot length for effective flushing of the sludge into a suction header. Some steam generators, however, have tube lanes of only 0.1" width and, due to the configuration of the tubes, will require that lengths of nearly 10 feet need to be lanced. To align a jet of water to pass down a lane of this small width for such a long distance, is not practical. For this reason, the fundamental decision has been made to apply the jet action from nozzles positioned down the lanes formed by closely-spaced tubes. These jets of high-pressure fluid will be applied primarily to soften, liquify, and loosen the hard-packed sludge material. By expanding the surface of the body of the sludge, more effective contact with subsequently applied chemicals can be attained. The chemicals will effectively dissolve the sludge materials for final removal. The present problem then centers around the provision of a lance configuration and its support for manipulation along the tube lanes to bring the fluid jetted from the lance into effective contact with the sludge material about the tubes extending above their tube sheet.

DISCLOSURE OF THE INVENTION

The present invention functions to direct small, intense streams of fluid into a body of sludge which has accumulated above a tube sheet and between the tubes extending vertically from their tube sheet. The purpose of the jetted fluid is to break up the rather consolidated body of sludge and expand its surface. This action is desirable in preparation for contact with chemicals which will dissolve the materials of the sludge and facilitate withdrawal of the resulting solution. By selectively directing capillary tips, the fluid jets can also be used to flush the sludge out of the tube sheet area.

The present invention contemplates a structure for support of one or more capillary tubes in order for the end of the capillaries to be moved down lanes of the tubes in directing the jetted fluid from the capillaries into the sludge body.

The invention further contemplates a capillary tube, or tubes, mounted on a flat, elongated metallic strip, to form a combination rigid enough to be inserted down tube lanes while possessing enough flexibility for diverting laterally from the line of force applied to the rear of the combination for entry into the tube lanes.

The invention further contemplates flexibility of the strip-mounted capillary tube, or tubes, being attained by a serpentine configuration of the capillaries along the length of the strip.

The invention further contemplates that there are other obvious means of attaining the required flexibility and strength such as the use of sheets attached above and below the capillary tubes by some means such as the silver solder technique.

The invention further contemplates the discharge ends of the capillary tube, or tubes, being provided with an orifice sized to jet the fluid with the force satisfactory for penetration of the sludge body while the end of the capillary tube, or tubes is directionally deviated from the tube axis.

Other objects, advantages and features of this invention will become apparent to one skilled in the art upon consideration of the written specification, appended claims, and attached drawings.

BEST MODE FOR CARRYING OUT THE INVENTION

The Steam Generator

In a U-tube type steam generator, a tube sheet supports a bundle of heat transfer U-shaped tubes. During operation, a sludge may form on the tube sheet and around the U-tubes, leading to failure of the tube walls. Failure of the tube walls results in a release of radioactive particles from the primary reactor coolant into the feedwater of the steam generator. The invention, herein described, is a lance used in removing this sludge accumulation before it can lead to tube-wall failure.

Figure 1:
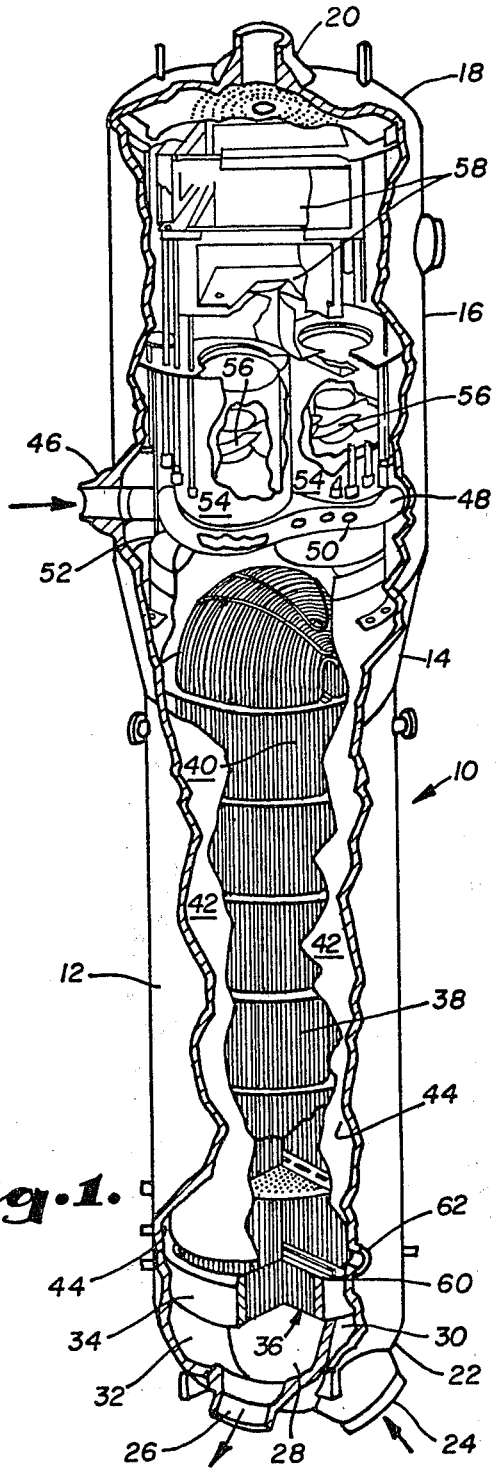
FIG. 1 is a partial cross-sectional view in elevation of a typical steam generator.

Referring to FIG. 1, a nuclear steam generator designated generally at 10, comprises a lower shell 12 connected to a frustoconical transition shell 14 which connects lower shell 12 to an upper shell 16. A dished head 18 having a steam nozzle 20 disposed thereon encloses upper shell 16 while a substantially spherical head 22 having inlet nozzle 24 and an outlet nozzle 26 disposed thereon encloses lower shell 12. A dividing plate 28, centrally disposed in spherical head 22, divides spherical head 22 into an inlet compartment 30 and an outlet compartment 32. The inlet compartment 30 is in fluid communication with inlet nozzle 24 while outlet compartment 32 is in fluid communication with outlet nozzle 26. A tube sheet 34 having tube holes 36 therein is attached to lower shell 12 and spherical head 22 so as to isolate the portion of steam generator 10 above tube sheet 34 from the portion below tube sheet 34 in a fluid-tight manner. Tubes 38 which are heat transfer tubes shaped with a U-like curvature are disposed in tube holes 36. The tubes 38 which may number about 7,000, form a tube bundle 40. Dividing plate 28 is attached to tube sheet 34 so that inlet compartment 30 is physically divided from outlet compartment 32. Each tube 38 extends from tube sheet 34 where one end of each tube 38 is in fluid communication with inlet compartment 30, up into transition shell 14 where each tube 38 is formed in a U-like configuration, and back down to tube sheet 34 where the other end of each tube 38 is in fluid communication with outlet compartment 32. In operation, the reactor coolant having been heated from circulation through the reactor core, enters steam generator 10 through inlet nozzle 24 and flows into inlet compartment 30. From inlet compartment 30, the reactor coolant flows through tubes 38 in tube sheet 34, up through the U-shaped curvature of tubes 38, down through tubes 38 into outlet compartment 32. From outlet compartment 32, the reactor coolant is circulated through the remainder of the reactor coolant system in a manner well-known in the art.

Again referring to FIG. 1, tube bundle 40 is encircled by a wrapper 42 which extends from near the tube sheet 34 into the region of transition shell 14. Wrapper 42, together with lower shell 12, form a annular chamber 44. A secondary fluid, or feedwater, inlet nozzle 46 is disposed on upper shell 16 above tube bundle 40. A feedwater header 48, comprising three loops forming a generally cloverleaf-shaped ring, is attached to feedwater inlet nozzle 46. Feedwater header 48 has, therein, a plurality of discharge ports 50 arranged in varying arrays so that a greater number of discharge ports 50 are directed toward annular chamber 44 than are directed otherwise.

During operation, feedwater enters steam generator 10 through feedwater inlet nozzle 46, flows through feedwater header 48, and out of feedwater header 48 through discharge ports 50. The greater portion of the feedwater exiting discharge ports 50, flow down annular chamber 44 until the feedwater contacts tube sheet 34. Once reaching the bottom of annular chamber 44 near tube sheet 34, the feedwater is directed inward around tubes 38 of tube bundle 40 where the feedwater passes in a heat transfer relationship with tubes 38. The hot reactor coolant being in tubes 38 transfers heat through tubes 38 to the feedwater, thereby heating the feedwater. The heated feedwater then rises by natural circulation up through the tube bundle 40. In its travel around tube bundle 40, the feedwater continues to be heated until steam is produced in a manner well-known in the art.

Now referring to the upper portion of FIG. 1, wrapper 42 has an upper cover or wrapper head 52 disposed thereon above tube bundle 40. Disposed on wrapper head 52 are sleeves 54 which are in fluid communication with the steam produced near tube bundle 40 and have centrifugal swirl vanes 56 disposed therein. Disposed about sleeves 54 is a moisture separator 58 which may be a chevron moisture separator. The steam that is produced near tube bundle 40 rises through sleeves 54 where centrifugal swirl vanes 56 cause some of the moisture in the steam to be removed. From sleeves 54, the steam continues to rise through moisture separator 58 where more moisture is removed therefrom. Eventually, the steam rises through steam nozzle 20 from where it is conducted through usual machinery to produce electricity, all in a manner well-known in the art.

Referring to the lower portion of FIG. 1, due to the curvature of tubes 38, a straight-line section of tube sheet 34 is without tubes therein. This straight-line section is referred to as free lane 60. At least one handhole 62 is provided through the wall of shell 12 in alignment with free lane 60. Therefore, access to the tube lanes through the bundle 40 is provided through handhole 62 and free lane 60.

The Tube Sheet

Figure 2:
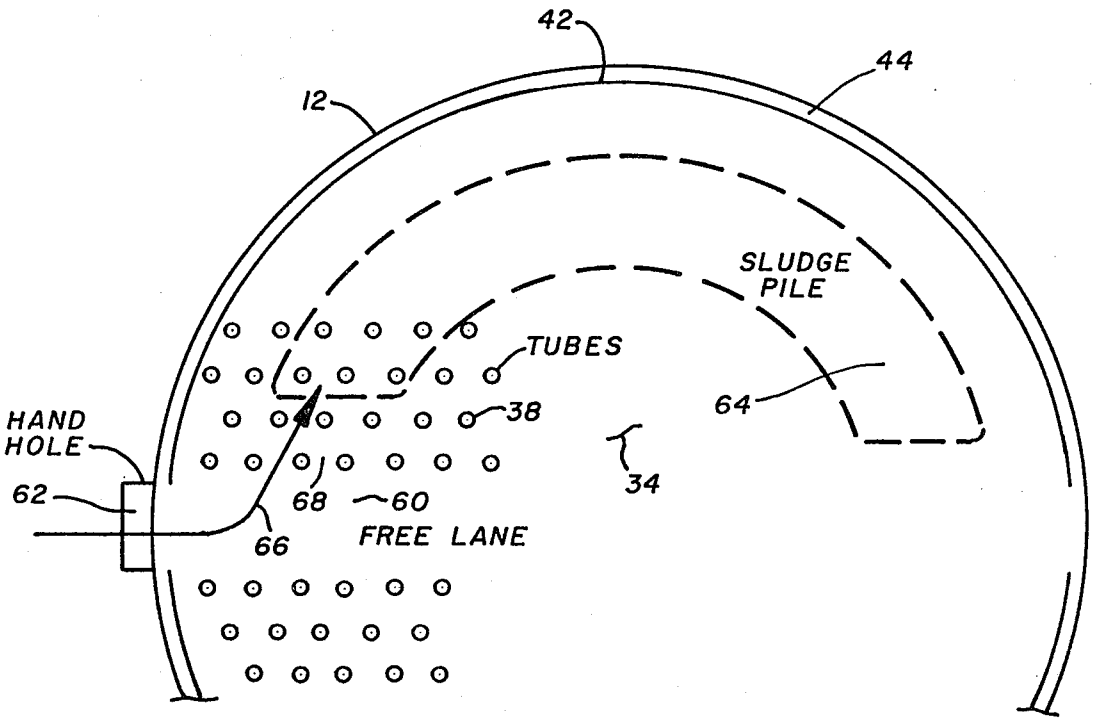
FIG. 2 is a plan view of a portion of the tube sheet of the steam generator of FIG. 1.

Referring to FIG. 2, there is disclosed a large portion of the tube sheet, as viewed from above, within the shell 12. The wrapper 42 is indicated forming the annulus 44. The tube sheet 34 has its tubes 38 indicated by circles.

FIG. 2 is designed to disclose the arrangement between handhole 62 through shell 12, aligned with free lane 60. Free lane 60 is that portion of the tube sheet remaining clear of tubes 38 of bundle 40. Handhole 62 is aligned with free lane 60 to provide access to the tube lanes, formed between tubes 38, with a high-pressure fluid lance embodying the present invention.

Sludge body 64 may take various configurations. One assumed configuration is indicated in FIG. 2 as it is distributed on the upper surface of the tube sheet 34 and about the tubes of bundle 40. The end result of properly applying the invention, is the injection of high-pressure fluid down into the sludge body 64 to more or less break it up and, by enlarging its surface, prepare its material for contact with chemicals which will dissolve the sludge material or allow it to be washed out of the tube bundle by the flow of fluids.

The embodiment of the present invention is not disclosed in FIG. 2. Disclosed is an arrow 66, dramatizing the path down which the lance is to be initially extended. This arrow 66 indicates the predetermined path of the lance as through handhole 62, along free lane 60, and through a tube lane 68. A diverter, or guide, structure will be subsequently disclosed as placed in free lane 60. This guide, or diverter, structure will engage the lance in the free lane 60 and force the forward end of the lance into tube lane 68. Within tube lane 68, the tubes forming the lane will thereafter provide side support for the lance as the lance advances from the guide structure and down the tube lane. As the forward end of the lance is advanced by force on the lance from its rear, the fluid ejected from the lance is directed down into that portion of the sludge body in the lower part of tube lane 68. After the forward end of the lance has reached the outer edge of the tube bundle, it is withdrawn along path 66. The diverter structure is moved down free lane 60 to another tube lane and the lance again is diverted into that second tube lane which will, again, carry it over the sludge body 64. FIG. 2, then, serves the purpose of disclosing the contemplated cooperation between the lance, handhole, diverter structure, free lane, and tube lanes, to jet high-pressure fluid down into sludge body 64.

Insertion of the Lance

Figure 3:
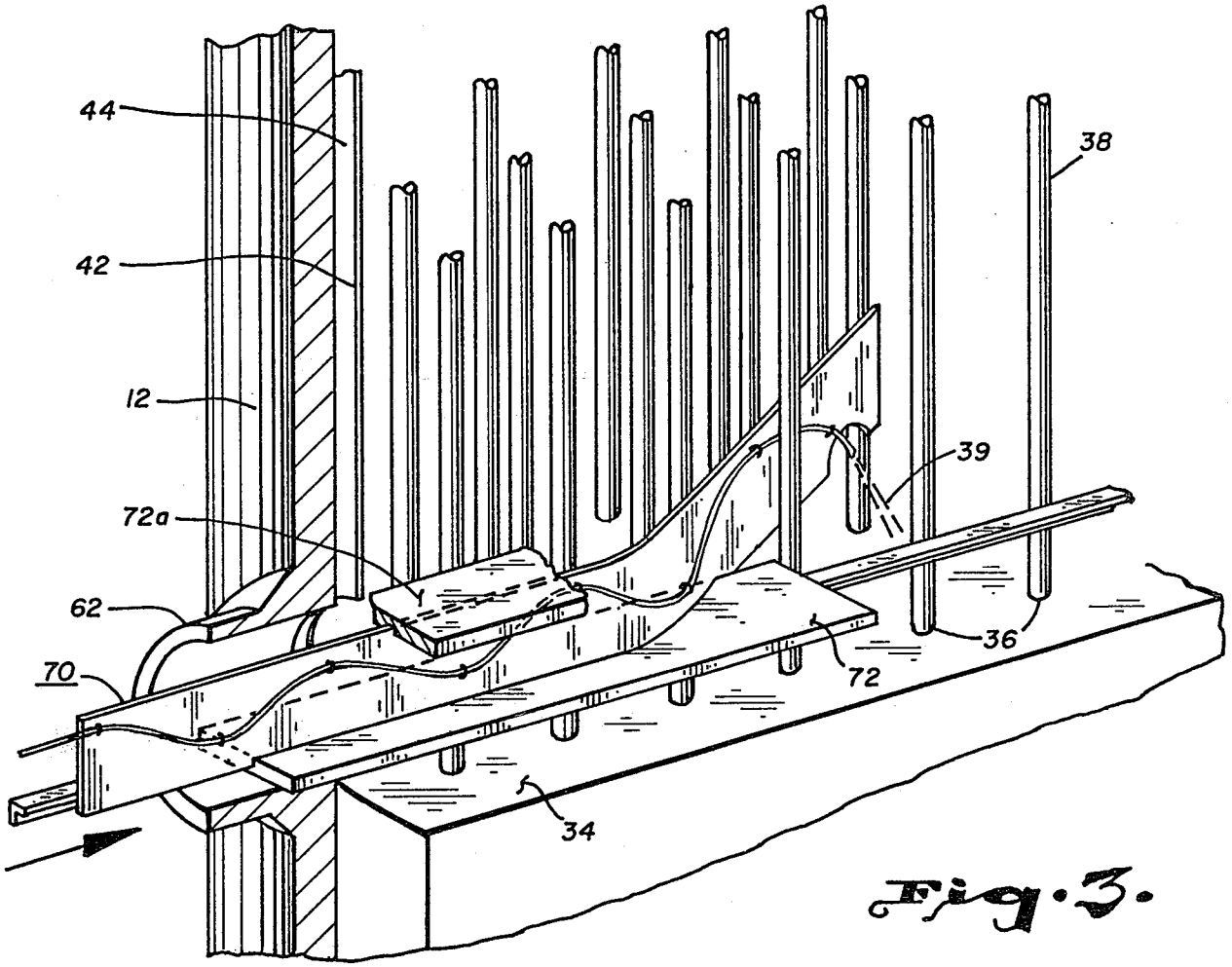
FIG. 3 is an isometric elevation of a portion of the steam generator of FIG. 1 with a lance embodying the present invention diverted to and inserted in a tube lane.

The teachings of FIG. 3 now become a logical extension of the teachings of FIG. 2. The same tube sheet portion 34 is disclosed with its tubes 38 in their relationship to free lane 60 and handhole 62 in the wall of shell 12.

Now, lance 72 is indicated as thrust through handhole 62, down free lane 60, and down tube lane 68 in order for its jets on its forward end to be carried over sludge body 64. The disclosure of the lance is not complete, the complete disclosure being reserved for a subsequent drawing figure. FIG. 3 serves the vital function of relating the lance to the diverter, or guide, structure portions 72 and **72*a*, and the guide structure to tube sheet 34**.

The lower part of the guide structure is supported at a predetermined distance above the upper surface of tube sheet 34. This distance is determined by, at least, the height of the handhole 62. The lance is forced into tube lane 68 at this height and essentially in a horizontal position which will enable its jetted fluid to be effectively directed downward into the sludge body and effectively break up the body for a subsequent chemical reaction or flushing action. FIG. 3 illustrates this support of the guide/diverter structure portions 72 and **72*a* above the tube sheet 34 at a position in the free lane 60** which will direct the lance into the selected tube lane.

Lance Construction

In disclosing the structure of the lance 70, terminology is generated with which to distinguish the tubes of bundle 40 from the fluid conduits mounted as a part of the lance. Both heat exchange tubes and the conduits for fluid to be jetted into the sludge body, carry fluids. However, they are distinguished at least in their size. The fluid-conducting elements of the lance 70 are termed capillary tubes which is a common designation for conductors of this small size.

Figure 4:
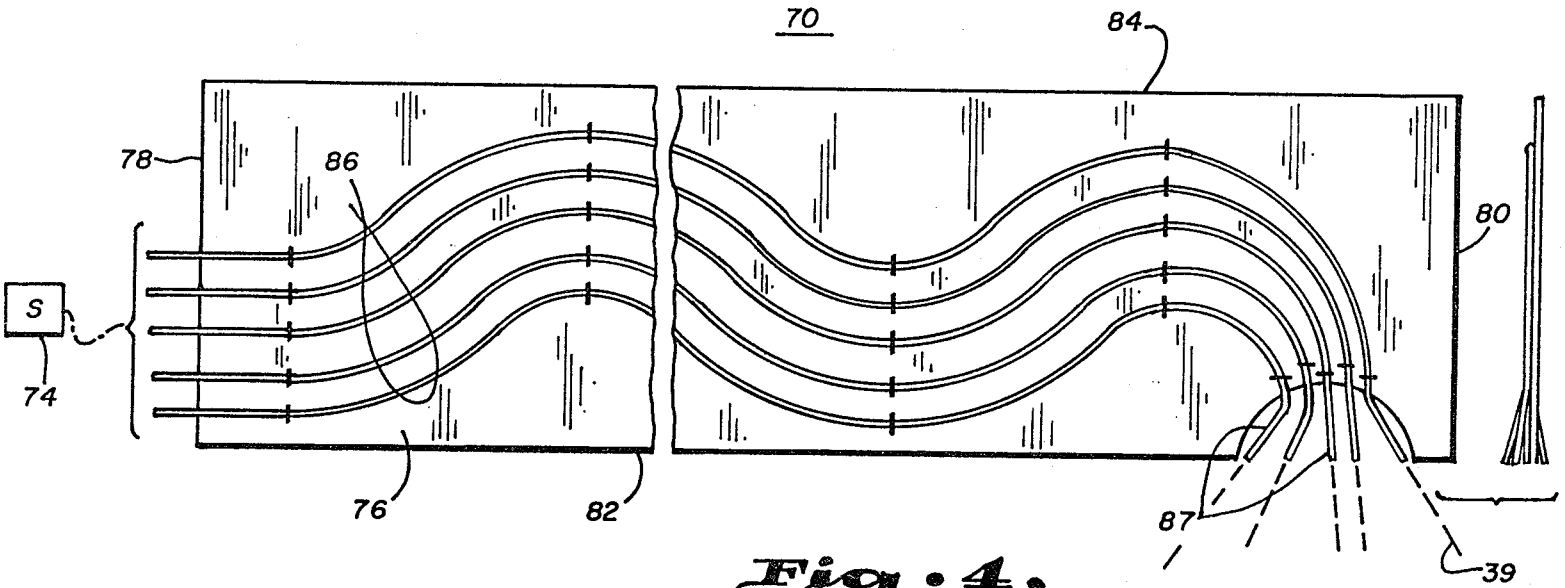
FIG. 4 is a side elevation of the lance of FIG. 3.

FIG. 4 discloses, in side elevation, the essential elements of the lance in which the invention is embodied. A source of high pressure fluid 74 is connected to the rear end of the capillaries of lance 70 in order for the forward discharge ends of the capillaries to direct the high pressure fluid into sludge body 64.

The base of lance 70 is preferably an elongated strip of spring steel 76. The material for this strip is selected for its toughness and high degree of elasticity. It is contemplated that a force applied to the rear portion 78 of strip 76 will force the forward portion 80 into engagement with the diverter/guide structures 72, **72*a* so that deflection from the axis of the strip will take place. It is further comtemplated that the strip 76 will be manipulated into the position disclosed in FIG. 3 so that edge 82 which is designated the lower edge of the strip and edge 84 which is designated the upper edge of the strip will respectively engage the portions 72 and 72*a*** of the diverter/guide structure at the bottom and at the top.

Strip 76 is the base to which capillaries are attached and collectively designated 86, as these capillaries are attached to one side of strip 76. Although the invention can be defined in terms of a single capillary 86 attached to a strip 76, the actual reduction to practice will undoubtedly utilize a plurality of such capillaries as shown in FIG. 4. In any event, the capillaries 86 will connect with source 74 at the rear end 78 of the strip and terminate near the forward end 80 of strip 76 to form nozzles 87.

The invention is not primarily concerned with the connection of the high-pressure fluid source 74 to the capillaries 86 which can be accomplished by any of several arrangements well-known in the art. The invention is concerned with the technique of using a spring-like material as a strip 76 in combination with small diameter, thin wall (capillary) tubes 86, to provide a lance that can be guided and inserted into the small tube lanes 68. By this means, the high-pressure fluid jet 39 can be directed against the sludge accumulation 64 from a relatively short distance above the sludge body so that it will retain its intensity and also be directed at an optimum angle to provide maximum cutting and flushing characteristics.

The combination of a flexible spring strip 76 and serpentine capillaries 86, shown in FIG. 4, is one simplified method of embodying the concepts of the invention. Other configurations of combining the stiffness and spring qualities of a thin strip in combination with the fluid-carrying capacity and relative low stiffness of the capillary tube are considered to be obvious extensions under the concepts of this invention and, therefore, are not delineated.

Conclusion

Some desultory dimensional information relating to the actual reduction to practice of the invention was set out in the Background Art section of this application. The disclosure will further benefit from more specific information concerning the dimensions of contemplated actual reductions to practice. First, there is a genre of nuclear steam generators whose tube bundles have lanes with widths in the order of 0.4". U.S. Pat. No. 4,079,701, supra, represents this group. Second, the present invention is demanded by a genre of steam generators whose tube bundles have lanes with widths in the order of 0.1". With these smaller tube lanes branching from the free lane, it is necessary for the present invention to provide a lance which will take fluid jets down these extremely narrow tube lanes to bring the jetting fluid within a foot of the sludge body to be broken up.

The lance base strip 76 is reduced to practice with shim stock in the order of 0.2" thickness. The capillary tubes mounted on the side of this strip are formed from 0.0625" diameter tubes so that the combination of tube and strip has a total thickness of less than 0.1". The diameter of the fluid stream jetted from each of these capillary tubes in only about 0.04". Finally, the pressure provided for the fluid from source 74 is in the order of 5,000 psi. It is this combination, making up the lance 70, which is thrust through handhole 62, down free lane 60, and diverted by structure 72, **72*a*** down the selected tube lanes.

After the lance has broken up the surface of the sludge body 64 with its jets, a suitable chemical solution is introduced to dissolve the material of the sludge body. The removal is quite a simple matter. Although a specific removal structure is not disclosed, it takes no great imagination to visualize a drain line extended down free lane 60 from outside the vessel. A source of suction on the external end of the drain line will readily remove the liquified sludge body from above the tube sheet.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A system having the end function of injecting fluid at high pressure into a body of sludge collected on the upper side of a tube sheet of a heat exchanger above which its tube bundle forms a free lane aligned with a handhole through the steam generator shell and the tubes form lanes at angles to the free lane, including, a thin metallic strip having high resiliency, at least one capillary tube attached to the metallic strip along the length of the strip, a nozzle formed on the end of the capillary tube and positioned at the front end of the strip for movement down the free lane above the tube sheet, a source of high pressure fluid connected to the rear end of the capillary to supply fluid to the nozzle, and a diverter structure positioned in the free lane above the tube sheet to engage the metallic strip and capillary combination to direct it down a tube lane which extends at an angle from the free lane.

2. The system of claim 1, wherein, the capillary tube is arranged along the metallic strip surface in serpentine configuration relative to the length of the strip.

3. The system of claim 1, including, a support for the diverter structure with which the diverter structure can be repositioned along the free lane to select the tube lane into which the strip and capillary tube is diverted from the free lane direction.

4. The system of claim 1, wherein, a plurality of capillary tubes are attached in parallel along the strip and extend their front ends beyond the edge of the strip at predetermined angles to jet their fluids into the body of sludge as required to break up and expand its surface.

5. A fluid lance for injecting high pressure fluid into a body or sludge collected in a steam generator above its tube sheet and about the lower ends of tubes mounted through the tube sheet, including, a rectangular strip of spring steel adapted to be thrust lengthwise into lanes formed between tubes of the steam generator, a capillary tube attached to the strip and extending toward the forward end of the strip to eject high-pressure fluid into a body of sludge above the tube sheet of the heat exchanger and extending backward from the strip to receive high-pressure fluid, a nozzle configuration formed with the capillary portion extending beyond the strip and directed toward the sludge body, and a source of high-pressure fluid connected to the capillary extending beyond the rear end of the strip.

6. The fluid lance of claim 5, in which, the capillary tube is attached to the side of the strip in a serpentine configuration to provide lateral flexibility for the combination of the strip and capillary.

7. The lance of claim 5 in combination with a guide mounted a predetermined distance above the surface of the tube sheet having grooves with which to engage the upper and lower edges of the strip to divert the forward end of the strip at a predetermined angle from its original axis.

8. The lance of claim 5, in which, the thickness of the strip is in the order of 0.02", the diameter of the capillary tube attached to the strip is in the order of 0.0625" in order for the total width of the strip and capillary to be in the order of less than 0.1", and the source provides fluid to the nozzle of the capillary with a pressure in the order of 5,000 psi.

* * * * *